US008469283B2

(12) United States Patent
Sanger et al.

(10) Patent No.: US 8,469,283 B2
(45) Date of Patent: Jun. 25, 2013

(54) LIQUID HEAT GENERATOR WITH INTEGRAL HEAT EXCHANGER

(75) Inventors: Jeremy J. Sanger, Milford, MI (US); Franco Garavoglia, Commerce Township, MI (US)

(73) Assignee: Ventech, LLC, Wixom, MI (US)

( * ) Notice: Subject to any disclaimer, the term of this patent is extended or adjusted under 35 U.S.C. 154(b) by 1000 days.

(21) Appl. No.: 12/511,651

(22) Filed: Jul. 29, 2009

(65) Prior Publication Data

US 2010/0025486 A1 Feb. 4, 2010

Related U.S. Application Data

(60) Provisional application No. 61/084,517, filed on Jul. 29, 2008.

(51) Int. Cl.

| | |
|---|---|
| ***B60H 1/22*** | (2006.01) |
| *B60H 1/02* | (2006.01) |
| *B60H 1/03* | (2006.01) |
| *B60H 1/04* | (2006.01) |
| *F24J 3/00* | (2006.01) |

(52) U.S. Cl.

USPC ... 237/12.3 B; 237/8 A; 237/8 R; 237/12.3 R; 237/19; 237/34; 122/1 R; 122/3; 122/26; 122/18.1; 123/142.5 R; 126/247; 126/344; 415/55.1

(58) Field of Classification Search

CPC ..... B60H 1/038; F24J 3/003

USPC ..... 237/8 A, 8 R, 12.3 B, 12.3 R, 19, 237/34; 122/1 C, 3, 11, 18.1, 18.2, 18.3, 122/18.4, 19.1, 26; 123/41.44, 142.5 R; 126/247, 344; 137/625.48, 878, 881; 165/156; 415/55.1

IPC . B60H 1/02, 1/03, 1/04, 1/22; F24J 3/00; F02N 99/00

See application file for complete search history.

(56) References Cited

U.S. PATENT DOCUMENTS

| | | | |
|---|---|---|---|
| 1,760,402 | A | 5/1930 | Derrick |
| 1,915,547 | A | 6/1933 | North et al. |

(Continued)

FOREIGN PATENT DOCUMENTS

| | | | |
|---|---|---|---|
| DE | 12 13 270 | B | 3/1966 |
| DE | 3147468 | A1 | 12/1982 |

(Continued)

OTHER PUBLICATIONS

PCT International Search Reported dated Mar. 8, 2010 for PCT/US2009/052113.

(Continued)

*Primary Examiner* — Steven B McAllister
*Assistant Examiner* — Daniel E Namay
(74) *Attorney, Agent, or Firm* — Young Basile Hanlon & MacFarlane PC; Daniel J. Checkowsky

(57) ABSTRACT

Disclosed herein is an exemplary supplemental heating system including a hydrodynamic heater and a heat exchanger. The hydrodynamic heater includes a hydrodynamic chamber disposed within an interior cavity of the hydrodynamic heater. The hydrodynamic chamber is operable for selectively heating a fluid present within the hydrodynamic chamber when the heating apparatus is connected to a fluid supply source. The hydrodynamic heater includes an inlet port fluidly connected to a discharge port of the heat exchanger, and a discharge port fluidly connected to an inlet port of the heat exchanger. The heat exchanger includes a heat exchanger core disposed within an interior cavity of the heat exchanger. A wall at least partially defines the interior cavity of the hydrodynamic heater and the interior cavity of the heat exchanger.

19 Claims, 6 Drawing Sheets

U.S. PATENT DOCUMENTS 2,428,005 A 9/1947 Bennett
2,496,497 A 2/1950 Russell
2,541,227 A 2/1951 Findley
2,570,768 A 10/1951 Clerk
2,672,954 A 3/1954 Bennett
2,748,762 A 6/1956 Booth
2,748,899 A 6/1956 Booth et al.
2,749,049 A 6/1956 Smith
2,750,009 A 6/1956 Pohl
2,827,989 A 3/1958 Christenson
2,889,013 A 6/1959 Schneider
2,990,919 A 7/1961 Christenson et al.
3,024,876 A 3/1962 Montgomery
3,051,273 A 8/1962 Cordiano et al.
3,122,319 A 2/1964 Friedel et al.
3,136,392 A 6/1964 Rodway
3,139,158 A 6/1964 Sieving
3,146,863 A 9/1964 Herbenar et al.
3,164,961 A 1/1965 Schroder
3,178,889 A 4/1965 Nelden
3,265,162 A 8/1966 Botterill
3,270,838 A 9/1966 Schweizer
3,330,386 A 7/1967 Bertram et al.
3,405,524 A 10/1968 Nelden
3,451,511 A 6/1969 Knapp
3,467,225 A 9/1969 Steffen et al.
3,512,616 A 5/1970 Bessiere
3,591,079 A 7/1971 Peters
3,601,211 A 8/1971 Finke
3,650,358 A 3/1972 Bessiere
3,661,325 A * 5/1972 Altenstadt ..... 237/8 R
3,684,335 A 8/1972 Franke et al.
3,720,372 A 3/1973 Jacobs
3,756,028 A 9/1973 Bopp et al.
3,774,734 A 11/1973 Forster et al.
3,774,735 A 11/1973 Hanke et al.
3,860,097 A 1/1975 Braschler et al.
3,888,335 A 6/1975 Hanke
3,919,844 A 11/1975 Elderton
3,924,713 A 12/1975 Bessiere
3,941,224 A 3/1976 Hanke
3,952,508 A 4/1976 Bopp
3,989,127 A 11/1976 Staudenmaier et al.
4,004,660 A 1/1977 Shore et al.
4,043,434 A 8/1977 Braschler
4,061,214 A 12/1977 Ternehall
4,073,139 A 2/1978 Armasow et al.
4,175,647 A 11/1979 Hanke
4,201,050 A 5/1980 Nixel
4,257,504 A 3/1981 Hanke
4,276,970 A 7/1981 Herrmann et al.
4,285,329 A 8/1981 Moline
4,373,666 A 2/1983 Williams
4,386,735 A 6/1983 Tholen et al.
4,405,038 A 9/1983 Ternehall
4,407,449 A 10/1983 Moser et al.
4,411,340 A 10/1983 Brosius et al.
4,430,966 A 2/1984 Marandet et al.
4,432,442 A 2/1984 Vogelsang
4,440,272 A 4/1984 Bieber
4,454,935 A 6/1984 Pryor
4,458,792 A 7/1984 Thomas et al.
4,474,270 A 10/1984 Vogelsang
4,493,293 A 1/1985 Paul et al.
4,538,553 A 9/1985 Kurz et al.
4,597,481 A 7/1986 Muller et al.
4,671,061 A 6/1987 Elderton
4,699,022 A 10/1987 Stadt et al.
4,733,635 A 3/1988 Menard et al.
4,773,513 A 9/1988 Herrmann et al.
4,836,341 A 6/1989 Hall, III
4,892,248 A 1/1990 Robin et al.
4,922,872 A 5/1990 Nogami et al.
4,938,323 A 7/1990 Holler et al.
5,036,829 A * 8/1991 Woo ..... 126/113
5,048,752 A 9/1991 Hintennach et al.
5,090,523 A 2/1992 Vogelsang
5,193,654 A 3/1993 Vogelsang
5,333,707 A 8/1994 Kaneda
5,657,723 A 8/1997 Edelmann et al.
5,657,838 A 8/1997 Vogelsang et al.
5,683,031 A 11/1997 Sanger
5,775,583 A 7/1998 Braatz et al.
5,779,008 A 7/1998 Vogelsang et al.
5,788,151 A 8/1998 Moroi et al.
5,794,588 A 8/1998 Vogelsang et al.
5,819,697 A 10/1998 Edelmann et al.
5,829,562 A 11/1998 Adams et al.
5,873,342 A 2/1999 Friedrich et al.
6,029,613 A * 2/2000 Ohshima et al. ..... 122/26
6,058,928 A 5/2000 Sitko et al.
6,059,198 A * 5/2000 Moroi et al. ..... 237/12.3 R
6,082,316 A 7/2000 Ban et al.
6,116,514 A 9/2000 Moroi et al.
6,167,993 B1 1/2001 Adams et al.
6,234,285 B1 5/2001 Friedrich et al.
6,558,112 B2 5/2003 Moroi et al.
6,561,324 B2 5/2003 Friedrich et al.
6,619,951 B2 * 9/2003 Bodnar et al. ..... 431/329
6,896,191 B2 5/2005 Augenstein et al.
7,069,728 B2 7/2006 Bruno et al.
7,380,728 B2 * 6/2008 Augenstein et al. ..... 237/12.3 B
2001/0018832 A1 9/2001 Matsunaga et al.
2002/0005181 A1 1/2002 Moroi et al.
2002/0117122 A1 * 8/2002 Lindner ..... 122/13.3
2005/0199207 A1 * 9/2005 Augenstein et al. ... 123/142.5 R
2005/0205682 A1 9/2005 Sanger et al.
2006/0011193 A1 * 1/2006 Rong ..... 126/651
2008/0006226 A1 * 1/2008 Takeda et al. ..... 122/18.1
2008/0060375 A1 3/2008 Sanger et al.
2008/0141951 A1 * 6/2008 Liu ..... 122/18.2
2009/0188447 A1 * 7/2009 Lutz ..... 122/17.1

FOREIGN PATENT DOCUMENTS

DE 3828470 A1 3/1990
DE 4415031 C1 5/1995
DE 19730678 A1 1/1999
DE 19744529 A1 2/1999
DE 19847607 A1 4/2000
DE 19901807 C1 7/2000
DE 10028280 A1 4/2001
DE 10136888 2/2003
DE 10144845 A1 3/2003
EP 0826530 3/1998
EP 0842800 A1 5/1998
EP 0796752 11/2001
FR 2263903 A1 10/1975
GB 2134245 8/1984
JP 61093340 A 5/1986
JP 02246823 A * 10/1990
JP 09277817 A * 10/1997
JP 10044749 2/1998
JP 10 297265 A 11/1998
JP 2002030932 A * 1/2002
JP 2002031075 A 1/2002
JP 2002181381 A 6/2002
JP 2007505284 T 3/2007
WO WO-/0281979 A1 10/2002
WO WO 2005082653 A1 * 9/2005
WO WO-2008 058376 A1 5/2008

OTHER PUBLICATIONS

PCT International Search Report for PCT/US08/50398 dated Jan. 7, 2008.
English Language Abstract for JP 61093340.
English Language Abstract for JP 2002181381.
English Language Abstract for JP 2002031075.
Russian Official Action (with translation) dated Feb. 27, 2009.
Supplementary European Search Report for EP05724145 dated Oct. 30, 2009.

* cited by examiner

LIQUID HEAT GENERATOR WITH INTEGRAL HEAT EXCHANGER

CROSS REFERENCE TO RELATED APPLICATIONS

This application claims priority to U.S. provisional patent application Ser. No. 61/084,517, filed on Jul. 29, 2008, the disclosures of which are incorporated herein by reference in its entirety.

BACKGROUND

Conventional automotive vehicles, such as automobiles, trucks and buses, typically include a heating system for supplying warm air to a passenger compartment of the vehicle. The heating system includes a control system that allows a vehicle operator to regulate the quantity and/or temperature of air delivered to the passenger compartment so as to achieve a desired air temperature within the passenger compartment. Cooling fluid from the vehicle's engine cooling system is commonly used as a source of heat for heating the air delivered to the passenger compartment.

The heating system typically includes a heat exchanger fluidly connected to the vehicle's engine cooling system. Warm cooling fluid from the engine cooling system passes through the heat exchanger where it gives up heat to a cool air supply flowing through the heating system. The heat energy transferred from the warm cooling fluid to the cool air supply causes the temperature of the air to rise. The heated air is discharged into the passenger compartment to warm the interior of the vehicle to a desired air temperature.

The vehicle's engine cooling system provides a convenient source of heat for heating the vehicle's passenger compartment. One disadvantage of using the engine cooling fluid as a heat source, however, is that there may be a significant delay between when the vehicle's engine is first started and when the heating system begins supplying air at a preferred temperature. This may occur, for example, when the vehicle is operated in very cold ambient conditions or has sat idle for a period of time. The delay is due to the cooling fluid being at substantially the same temperature as the air flowing through the heating system and into the passenger compartment when the engine is first started. As the engine continues to operate, a portion of the heat generated as a byproduct of combusting a mixture of fuel and air in the engine cylinders is transferred to the cooling fluid, causing the temperature of the cooling fluid to rise. Since, the temperature of the air discharged from the heating system is a function of the temperature of the cooling fluid passing through the heat exchanger, the heating system will generally produce proportionally less heat while the engine cooling fluid is warming up than when the cooling fluid is at a desired operating temperature. Thus, there may be an extended period of time between when the vehicle's engine is first started and when the heating system begins producing air at an acceptable temperature level. The time it takes for this to occur will vary depending on various factors, including the initial temperature of the cooling fluid and the initial temperature of the air being heated. It is preferable that the temperature of the cooling fluid reach its desired operating temperature as quickly as possible.

Another potential limitation of using the engine cooling fluid as a heat source for the vehicle's heating system is that under certain operating conditions the engine may not be rejecting sufficient heat to the cooling fluid to enable the air stream from the vehicle's heating system to achieve a desired temperature. This may occur, for example, when operating a vehicle with a very efficient engine under a low load condition or in conditions where the outside ambient temperature is unusually cold. Both of these conditions reduce the amount of heat that needs to be transferred from the engine to the cooling fluid to maintain a desired engine operating temperature. This results in less heat energy available for heating the air flowing through the vehicle's heating system.

DETAILED DESCRIPTION

Figure 1:
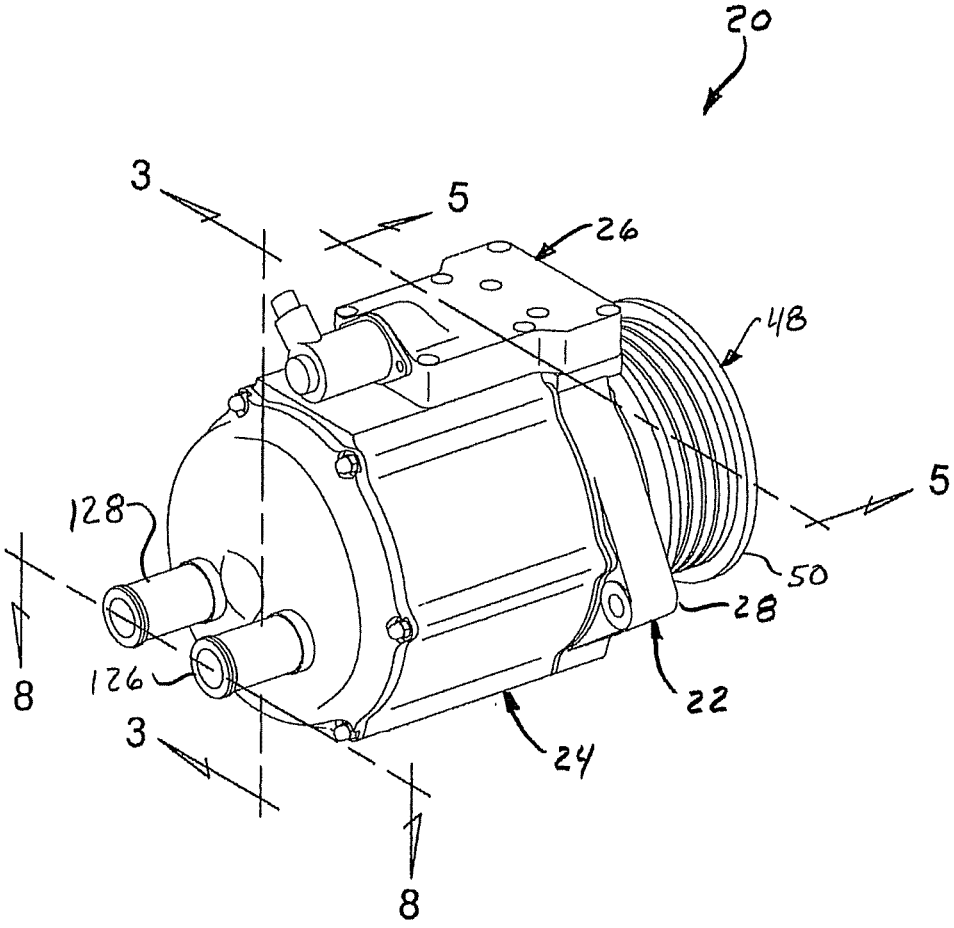
FIG. 1 is a rear perspective view of an exemplary supplemental heating system having an integrated heat exchanger.

Referring now to the discussion that follows and also to the drawings, illustrative approaches to the disclosed systems and methods are shown in detail. Although the drawings represent some possible approaches, the drawings are not necessarily to scale and certain features may be exaggerated, removed, or partially sectioned to better illustrate and explain the disclosed device. Further, the descriptions set forth herein are not intended to be exhaustive or otherwise limit or restrict the claims to the precise forms and configurations shown in the drawings and disclosed in the following detailed description.

Figure 2:
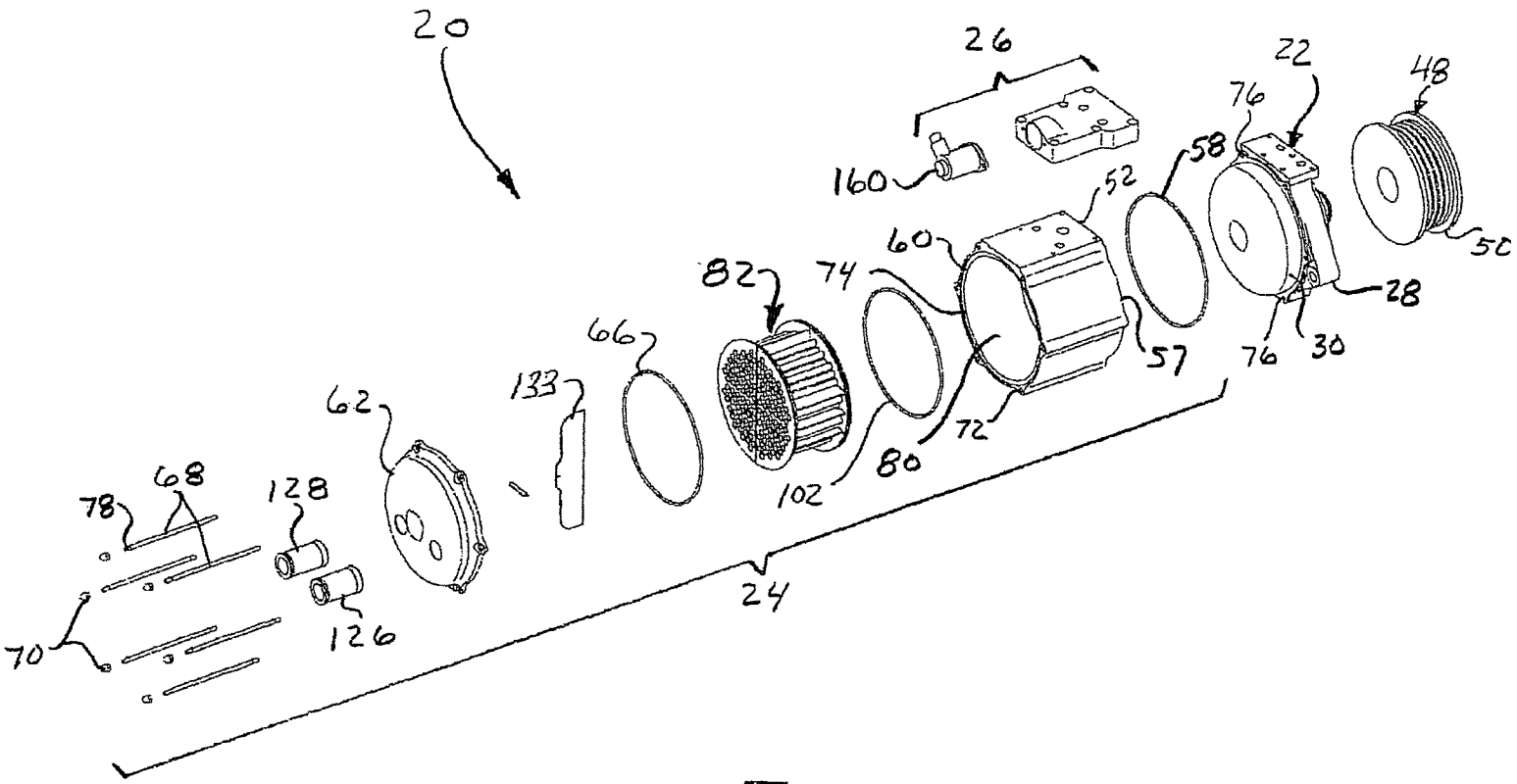
FIG. 2 is an exploded view of the exemplary supplemental heating system.

FIGS. 1 and 2 illustrate an exemplary supplemental heating system 20 that may be fluidly connected, for example, to an automotive cooling system, for supplying heat to warm a passenger compartment of the vehicle. Supplemental heating system 20 may include a hydrodynamic heater 22 operable for heating a fluid passing through the hydrodynamic heater. Examples of hydrodynamic heaters that may be employed with supplemental heating system 20 are disclosed in U.S. Pat. No. 5,683,031, entitled Liquid Heat Generator, which issued to Sanger on Nov. 4, 1997; U.S. application Ser. No. 11/068,285, entitled Vehicle Supplemental Heating System, which was filed on Feb. 28, 2005 and published as US 2005/0205682 on Sep. 22, 2005; and U.S. application Ser. No. 11/620,682, entitled Vehicle Supplemental Heating system, which was filed on Jan. 7, 2007 and published as US 2008/0060375 on Mar. 13, 2008, each of which is incorporated herein by reference in their entirety. Attached to hydrodynamic heater 22 is a heat exchanger 24. Supplemental heating system 20 may also include a manifold 26 for selectively controlling the distribution of fluid between hydrodynamic heater 22 and heat exchanger 24.

Figure 8:
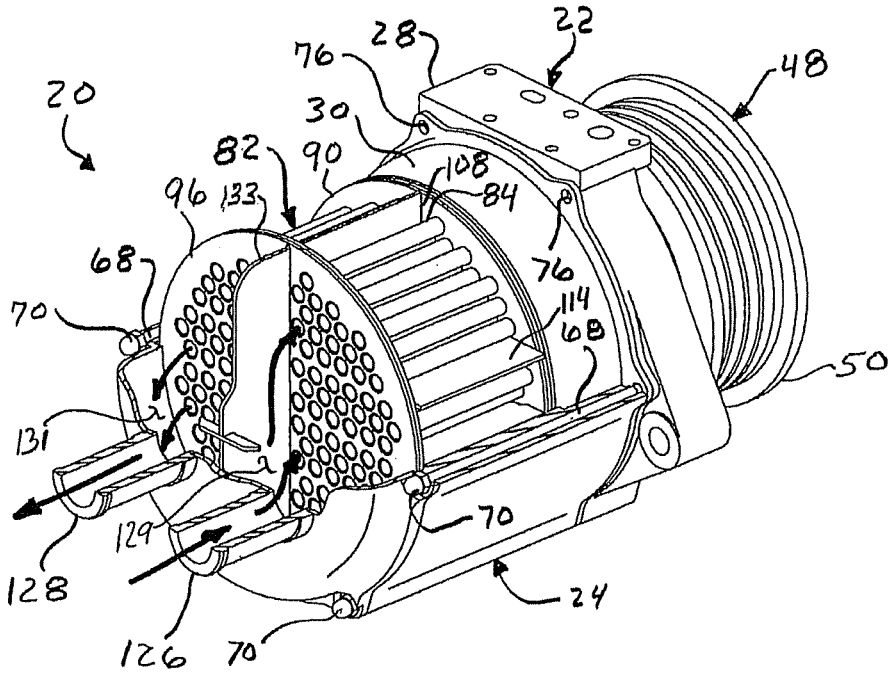
FIG. 8 is partially sectioned rear perspective view of the exemplary supplemental heating system, with the manifold removed.
Figure 9:
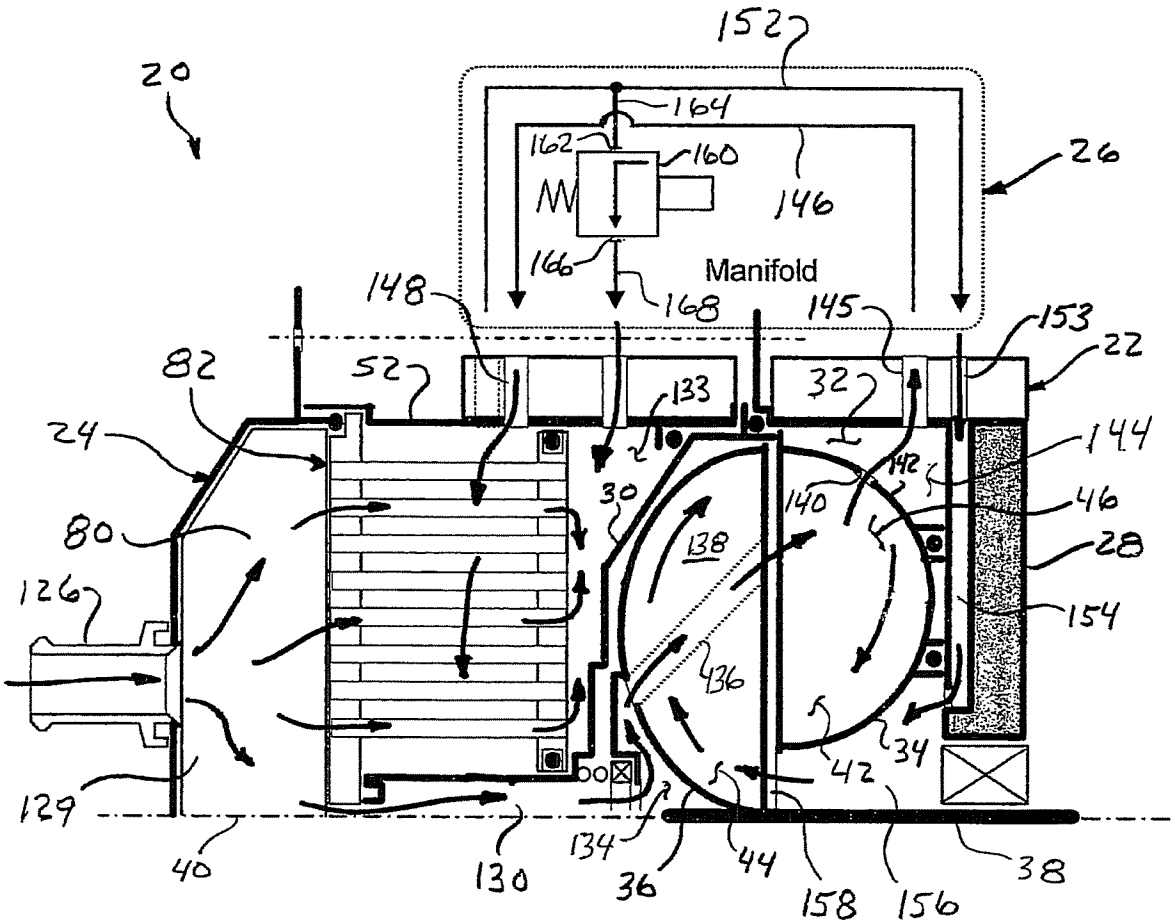
FIG. 9 is schematic depiction of the exemplary supplemental heating system.

Referring also to FIG. 9, which is a schematic illustration of supplemental heating system 20, hydrodynamic heater 22 is shown to include a housing 28 and a hydrodynamic heater cap 30 fixedly attached to the housing. Hydrodynamic heater cap 30 is also viewable in FIGS. 3 and 8. Hydrodynamic heater housing 28 and hydrodynamic heater cap 30 together define an interior fluid cavity 32. Disposed within interior cavity 32 is a stator 34 and a coaxially aligned rotor 36 positioned adjacent stator 34. Stator 34 may be fixedly attached to hydrodynamic heater housing 28. Rotor 36 may be mounted on a drive shaft 38 for concurrent rotation therewith about an axis 40. Stator 34 and rotor 36 define annular cavities 42 and 44, respectively, which together define a hydrodynamic chamber 46. Fluid heating occurs within hydrodynamic chamber 46. The heated fluid may be transferred between hydrodynamic heater 22 and heat exchanger 24 through passages in manifold 26.

Power for rotatably driving rotor 36 may be supplied by any of a variety of power sources, including but not limited to an engine of the vehicle in which the supplemental heating system is installed. An end of drive shaft 38 extends from hydrodynamic heater housing 28. Fixedly attached to the end of drive shaft 38 is a drive means 48, which may include a pulley 50 engageable with, for example, an engine accessory drive belt. The accessory drive belt may in turn engage an accessory drive attached to a crankshaft of the vehicle engine. The accessory drive belt transfers torque generated by the engine to drive shaft 38 connected to rotor 36. It is also contemplated that drive shaft 38 may be alternatively driven by another suitable means, such as an electric motor.

Drive means 48 may include a clutch, which may, for example and without limitation, be an electromagnetic clutch. The clutch may be selectively engaged in response to the particular heating requirements of the system. The clutch may be operated to disengage rotor 36 from the power supply when no additional heating of the fluid is required, which may be desirable, for example, to minimize the power being drawn from the vehicle engine for improving engine efficiency and to help maximize the amount of power available for other uses, such as propelling the vehicle.

Figure 3:
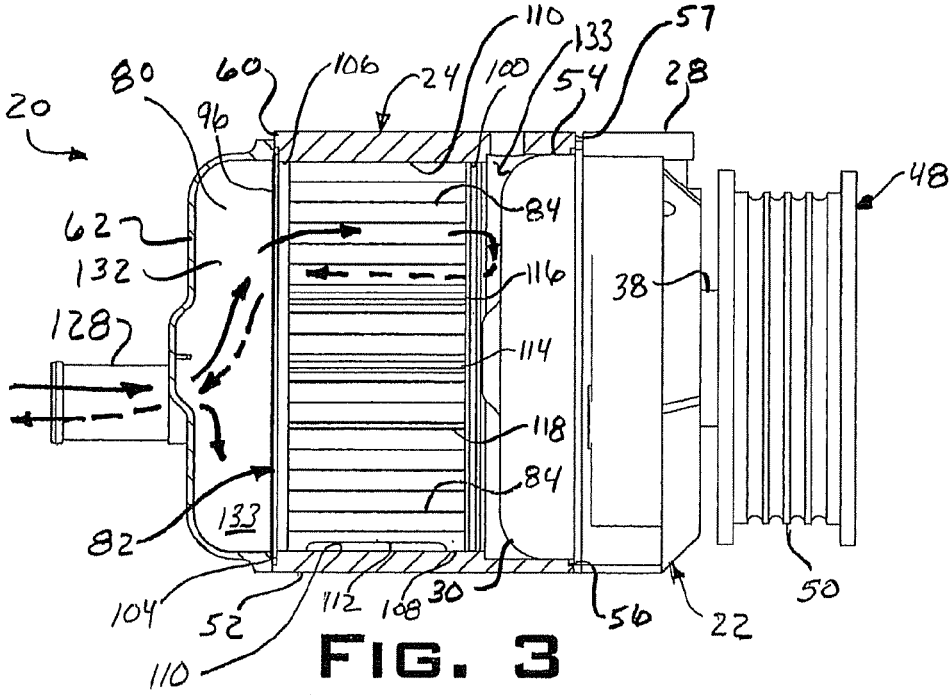
FIG. 3 is a partially sectioned side elevational view of the exemplary supplemental heating system, with a manifold removed.

Referring also to FIG. 3, heat exchanger 24 may include a generally cylindrically shaped housing 52 that engages an outer circumference 54 of hydrodynamic heater cap 30 and is fixedly secured to hydrodynamic heater housing 28. Hydrodynamic heater cap 30 has a generally outwardly convex shape that extends into heat exchanger housing 52 when heat exchanger housing 52 is attached to hydrodynamic heater housing 28. Outer circumference 54 of the hydrodynamic heater cap 30 may have a slightly smaller diameter than an interior diameter 55 of heat exchanger housing 52 to provide a pilot for positioning the heat exchanger housing relative to the hydrodynamic heater housing. A forward end 57 of heat exchanger housing 52 may include a circumferential notch 56 for receiving an o-ring 58. For clarity, o-ring 58 is not shown in FIG. 3, but is shown in FIG. 2. O-ring 58 forms a seal between heat exchanger housing 52 and hydrodynamic heater housing 28 when the two components are connected together.

Attached to an end 60 of heat exchanger housing 52 is an end cap 62. End 60 of heat exchanger housing 52 includes a circumferential o-ring notch 64. An o-ring 66 is positioned within notch 64 to form a seal between heat exchanger housing 52 and end cap 62. For clarity, o-ring 66 is not shown in FIG. 3, but is shown in FIG. 2.

One or more threaded studs 68 and nuts 70 may be used to secure end cap 62 and heat exchanger housing 52 to hydrodynamic heater housing 28. Studs 68 extend through axial holes 72 (see also FIG. 5) formed in a wall 74 of heat exchanger housing 52, and engage a corresponding threaded hole 76 (see also FIG. 8) in hydrodynamic heater housing 28. Attached to an opposite end 78 of stud 68 is nut 70.

Figure 4:
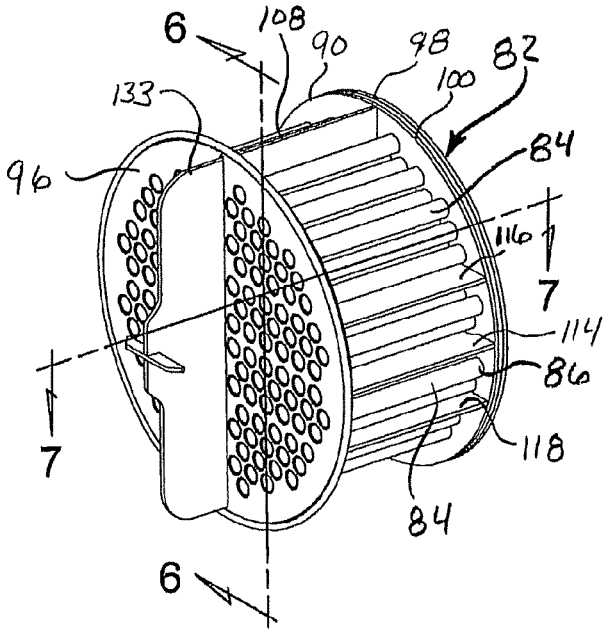
FIG. 4 is a rear perspective view of a heater core employed with the exemplary supplemental heating system.
Figure 5:
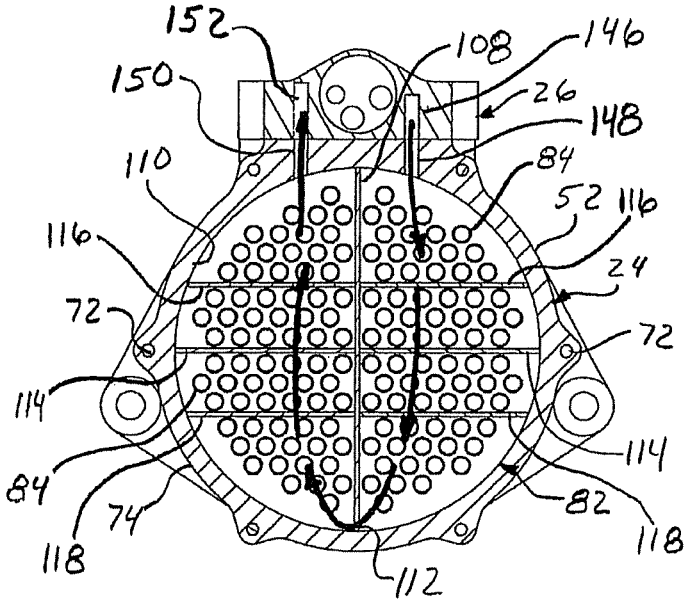
FIG. 5 is a rear partial sectional view of the exemplary supplemental heating system.
Figure 6:
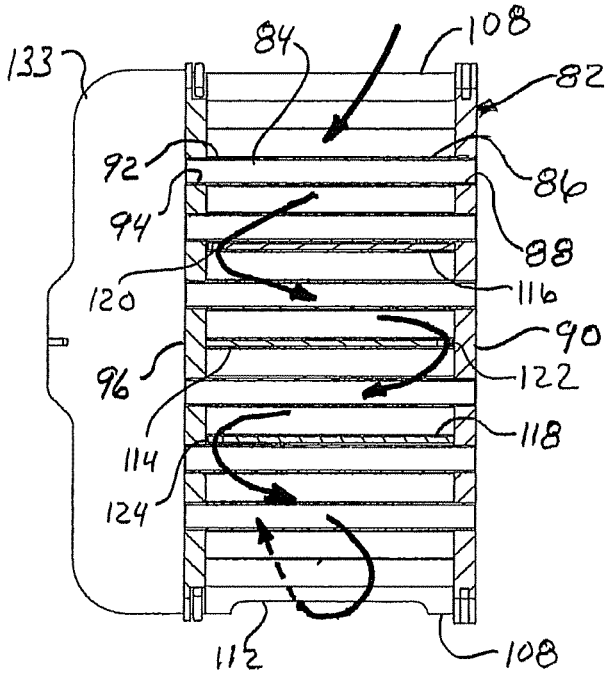
FIG. 6 is a side partial sectional view of the heater core employed with the exemplary heating system.
Figure 7:
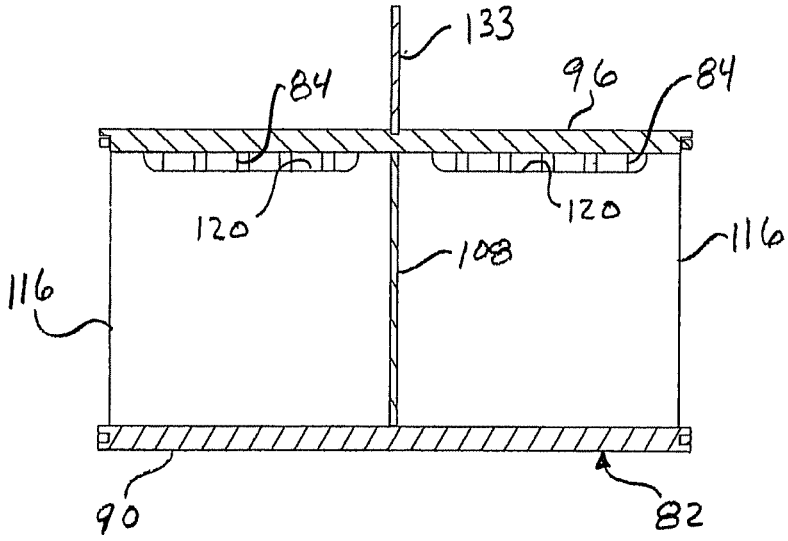
FIG. 7 is a top partial sectional view of the heater core employed with the exemplary supplemental heating system

With reference also to FIGS. 3-8, heat exchanger housing 52, hydrodynamic heater cap 30 and heat exchanger end cap 62 together define an internal fluid cavity 80. Positioned within fluid cavity 80 is a heat exchanger core 82. Heat exchanger core 82 includes a plurality of spaced apart elongated tubes 84. The longitudinal axis of tubes 84 are arranged generally parallel to a longitudinal axis of heat exchanger housing 52. With particular reference to FIG. 6, an end 86 of each of the tubes 84 engages a corresponding aperture 88 in a heat exchanger core forward end plate 90, and an opposite end 92 engages a corresponding aperture 94 in a heat exchanger core rear end plate 96. Tubes 84 may be secured to heat exchanger core end plates 90 and 96 by any suitable means, including but not limited to, welding, brazing, soldering, crinping and adhesives. Heat exchanger core forward end plate 90 and heat exchanger core rear end plate 96 are oriented generally perpendicular to the longitudinal axis of tubes 84.

With reference to FIG. 4, an outer edge 98 of heat exchanger core forward end plate 90 includes a circumferential o-ring groove 100. An o-ring 102 engages the o-ring groove to form a seal between heat exchanger housing 52 and forward heat exchanger end plate 90 when the heat exchanger core is installed in housing 52.

With reference to FIG. 3, heat exchanger core 82 is located within heat exchanger housing 52 by means of a flange 104 that extends radially outward from an outer edge 106 of heat exchanger core rear end plate 96. The flange is trapped between end 60 of heat exchanger housing 52 and end cap 62.

Referring to FIGS. 4-7, heat exchanger core 82 may employ one or more baffles to direct the heated fluid received from hydrodynamic heater 22 over the outer surface of tubes 84. A vertical baffle 108 divides heat exchanger core 82 into two halves. Vertical baffle 108 extends widthwise between heat exchanger core forward end plate 90 and heat exchanger core rear end plate 96, and lengthwise between diametrically opposed sides of an inner surface 110 of heat exchanger housing 52. As shown in FIG. 5, heated fluid from hydrodynamic heater 22 (represented by the arrows in FIG. 5) flows downward through one side of heat exchanger core 82 and up through the opposite side. A notched region 112, located at the bottom of vertical baffle 108, allows fluid to pass between the two sides of the heat exchanger core.

One or more horizontal baffle plates may also be provided for directing the heated fluid from hydrodynamic heater 22 over the outside surface of tubes 84. By way of example, heat exchanger core 82 may include a total of six horizontal baffles positioned on opposite sides of vertical baffle 108 (three baffles per side). A pair of middle horizontal baffles 114 are arranged on opposite sides of vertical baffle 108 and extend radially outward from a proximate center of the vertical baffle. Middle horizontal baffles 114 extend widthwise between heat exchanger core forward end plate 90 and heat exchanger core rear end plate 96, and lengthwise between vertical baffle 108 and inner surface 110 of heat exchanger housing 52. A pair of upper horizontal baffles 116 are arranged on opposite sides of vertical baffle 108, and extend generally parallel to middle baffles 114. Upper horizontal baffles 116 extend widthwise between heat exchanger core forward end plate 90 and heat exchanger core rear end plate 96, and lengthwise between vertical baffle 108 and inner surface 110 of heat exchanger housing 52. A pair of lower horizontal baffles 118 are arranged on opposite sides of vertical baffle 108 and extend generally parallel to middle baffles 114. Lower horizontal baffles 118 extend widthwise between heat exchanger core forward end plate 90 and heat exchanger core rear end plate 96, and lengthwise between vertical baffle 108 and inner surface 110 of heat exchanger housing 52.

Upper horizontal baffles 116, middle horizontal baffles 114, and lower horizontal baffles 118 each include a notched region arranged adjacent one of the heat exchanger core end plates 90 and 96. For example, upper horizontal baffles 116 include a notched region 120 positioned adjacent heat exchanger core rear end plate 96; middle horizontal baffles 114 include a notched region 122 positioned adjacent heat exchanger core forward end plate 90; and lower horizontal baffles 118 include a notched region 124 positioned adjacent heat exchanger core rear end plate 96. As shown in FIG. 6, the notched regions allow heated fluid from hydrodynamic heater 22 (represented by the arrows in FIG. 6) to flow around the horizontal baffles as the fluid flows down one side of the heat exchanger core and up the opposite side. Staggering the notched regions of adjacent horizontal baffles causes the heated fluid to travel along a generally back and forth path between heat exchanger core forward end plate 90 and heat exchanger core rear end plate 96 as the fluid travels down one side of the heat exchanger core and up the opposite side, as shown in FIGS. 5 and 6.

With reference to FIGS. 3-9, supplemental heating system 20 may be fluidly connected to a fluid supply source, such as an automotive cooling system, through an inlet port 126 and an outlet port 128. Fluid may be transferred from the vehicle cooling system to supplemental heating system 20 through inlet port 126 and returned to the cooling system through outlet port 128. Fluid entering supplemental heating system 20 through inlet port 126 is discharged into an inlet plenum 129. Fluid discharged from supplemental heating system 20 accumulates in an outlet plenum 131 prior to passing through outlet port 128. A plenum baffle 132 fluidly separates inlet plenum 129 from outlet plenum 131.

At least a portion of the fluid entering supplemental heating system 20 through inlet port 126 passes through tubes 84 that are fluidly connected to inlet plenum 129. The fluid picks up heat from the heated fluid discharged from hydrodynamic heater 22 as it passes over the outside of the tubes. The fluid is discharged from tubes 84 into an intermediate plenum 133 located between heat exchanger core front end plate 90 and hydrodynamic heater cap 30. Additional heat may also be transferred from hydrodynamic heater 22 through hydrodynamic heater cap 30 to the fluid passing through intermediate plenum 133. To promote heat transfer between hydrodynamic heater 22 and heat exchanger 24, hydrodynamic heater cap 30 may be constructed from a thermally conductive material. The fluid travels from intermediate plenum 133 through tubes 84 that are fluidly connected to outlet plenum 131, where the fluid picks up additional heat from the heated fluid flowing over the tubes. The fluid then discharges into outlet plenum 131, from which point the fluid flows out though outlet port 128 and back to the source of the fluid, for example, the vehicle cooling system.

With reference to FIG. 9, hydrodynamic chamber 46 of hydrodynamic heater 22 may be fluidly connected to the fluid supply source, for example, the engine cooling system, through inlet port 126. Fluid from the cooling system travels from inlet plenum 129 through a hydrodynamic chamber supply passage 130 and discharges into a hollow cavity 134 formed between the back of rotor 36 and hydrodynamic heater cap 30. One or more rotor passages 136 fluidly connect cavity 134 to hydrodynamic chamber 46. Rotor passage 136 extends through a blade 138 of rotor 36, and has one end fluidly connected to cavity 134 and an opposite end to hydrodynamic chamber 46.

Fluid present in hydrodynamic chamber 46 travels along a generally toroidal path within the chamber, absorbing heat as the fluid travels between annular cavities 42 and 44 of stator 34 and rotor 36, respectively. Heated fluid exits hydrodynamic chamber 46 through one or more discharge orifices 140 located along a back wall 142 of stator 34 near its outer circumference. Orifice 140 may be fluidly connected to a circumferential annulus 144 formed between hydrodynamic heater housing 28 and a back wall of stator 34. A hydrodynamic heater discharge port 145 fluidly connects annulus 144 to a hydrodynamic heater discharge passage 146 formed in manifold 26. Fluid exiting hydrodynamic chamber 46 through orifice 140 travels through discharge passage 146 to a heat exchanger inlet port 148 (see also FIG. 5). Fluid exits heat exchanger inlet port 148 and travels through heat exchanger core 82 in the manner generally shown in FIGS. 5 and 6. Generally speaking, the fluid passing over the outside of tubes 84 (i.e., the heated fluid discharged from hydrodynamic heater 22) is at a higher pressure than the fluid supply source, and the fluid flowing through tubes 84 and intermediate plenum 133 is at a lower pressure than the fluid over the outside of the tubes. At least a portion of the heat from the heated fluid is transferred to the fluid passing through tubes 84. The fluid exits heat exchanger 24 through a heat exchanger discharge port 150, shown in FIG. 5, and is directed back to hydrodynamic heater 22 through a return passage 152 formed in manifold 26. Manifold return passage 152 is fluidly connected to a hydrodynamic heater inlet port 153. Fluid entering the hydrodynamic heater through inlet port 153 passes through a hydrodynamic chamber return passage 154 formed in hydrodynamic heater housing 28. The fluid discharges from hydrodynamic chamber return passage 154 into an annular plenum 156 in hydrodynamic heater housing 28. The fluid enters hydrodynamic chamber 46 at an inner circumference 158 of the hydrodynamic chamber.

Manifold 26 may be constructed from any of a variety of generally inelastic materials, including but not limited to metals, plastics, and composites. Indeed, it may be desirable that substantially the entire fluid path between hydrodynamic heater discharge port 145 and heat exchanger inlet port 148 (i.e., discharge passage 146), and substantially the entire fluid path between heat exchanger discharge port 150 and hydrodynamic heater inlet port 153 (i.e., return passage 152), is constructed from an inelastic material. This may substantially reduce or eliminate difficulties in controlling the operation of hydrodynamic heater 22 that may arise when a generally elastic material is used in forming the fluid pathways between hydrodynamic heater 22 and heat exchanger 24.

Continuing to refer to FIG. 9, a control valve 160 (see also FIG. 1) controls the pressure occurring within hydrodynamic chamber 46, and consequently the corresponding heat output. An inlet port 162 of control valve 160 is fluidly connected to manifold return passage 152 through a control valve inlet passage 164, and an outlet port 166 is fluidly connected to intermediate plenum 133 of heat exchanger 24 through a control valve outlet passage 168. The pressure occurring within intermediate plenum 133 is generally lower than the pressure occurring within manifold return passage 152. Control valve 160 operates to selectively transfer a portion of the fluid passing through manifold return passage 152 to intermediate plenum 133. This reduces the amount of fluid returned to hydrodynamic chamber 46, thereby reducing the pressure occurring within the hydrodynamic chamber and its corresponding heat output.

With regard to the processes, systems, methods, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

It is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A heating apparatus connectable to a fluid supply source that supplies a fluid to be heated, the heating apparatus comprising:

a hydrodynamic heater including a hydrodynamic chamber disposed within an interior cavity of the hydrodynamic heater, the hydrodynamic chamber operable for selectively heating the fluid present within the hydrodynamic chamber when the heating apparatus is connected to the fluid supply source, the hydrodynamic heater having an inlet port and a discharge port;

a heat exchanger fluidly connected to the inlet port and the discharge port of the hydrodynamic heater, the heat exchanger including a heat exchanger core disposed within an interior cavity of the heat exchanger; and a wall at least partially defining the interior cavity of the hydrodynamic heater and the interior cavity of the heat exchanger.

2. The heating apparatus of claim 1 further comprising a manifold having a discharge passage fluidly connecting the discharge port of the hydrodynamic heater to an inlet port of the heat exchanger, and a return passage fluidly connecting a discharge port of the heat exchanger to the inlet port of the hydrodynamic heater.

3. The heating apparatus of claim 2, wherein the return passage is selectively fluidly connectable to a region of the interior cavity of the heat exchanger having a lower pressure than the pressure within the return passage.

4. The heating apparatus of claim 3 further comprising a valve operable to selectively fluidly connect the return passage to the interior cavity of the heat exchanger.

5. The heating apparatus of claim 2, wherein the manifold is constructed from a substantially inelastic material.

6. The heating apparatus of claim 1, wherein the heat exchanger includes a first region receiving fluid from the hydrodynamic heater and a second region receiving fluid from the fluid supply source, the second region fluidly connected to the wall that at least partially defines the interior cavity of the hydrodynamic heater and the interior cavity of the heat exchanger, and the first region fluidly disconnected from the wall.

7. The heating apparatus of claim 6, wherein at least a portion of the second region is disposed between the first region and the wall.

8. The heating apparatus of claim 1 further comprising a hydrodynamic heater housing at least partially defining the interior cavity of the hydrodynamic heater, and a heat exchanger housing at least partially defining the interior cavity of the heat exchanger, wherein the heat exchanger housing is attached to the hydrodynamic heater housing.

9. The heating apparatus of claim 1, wherein the wall is thermally conductive.

10. A heating apparatus connectable to a fluid supply source that supplies a fluid to be heated, the heating apparatus comprising:

a hydrodynamic heater including a hydrodynamic chamber disposed within an interior cavity of the hydrodynamic heater, the hydrodynamic chamber operable for selectively heating the fluid present within the hydrodynamic chamber when the heating apparatus is connected to the fluid supply source, the hydrodynamic heater having an inlet port and a discharge port;

a heat exchanger having an inlet port and a discharge port, the heat exchanger including a heat exchanger core disposed within an interior cavity of the heat exchanger; and a manifold having a discharge passage fluidly connecting the discharge port of the hydrodynamic heater to an inlet port of the heat exchanger, and a return passage fluidly connecting a discharge port of the heat exchanger to the inlet port of the hydrodynamic heater; and a wall at least partially defining the interior cavity of the hydrodynamic heater and the interior cavity of the heat exchanger.

11. The heating apparatus of claim 10, wherein the manifold is constructed from a substantially inelastic material.

12. The heating apparatus of claim 11, wherein the discharge passage is directly connected to the inlet port of the heat exchanger and the discharge port of the hydrodynamic heater, and the return passage is directly connected to the discharge port of the heat exchanger and the inlet port of the hydrodynamic heater.

13. The heating apparatus of claim 11, wherein substantially an entire fluid path between the discharge port of the hydrodynamic heater and the inlet port of the heat exchanger, and between the discharge port of the heat exchanger and the inlet port of the hydrodynamic heater is constructed from a substantially inelastic material.

14. The heating apparatus of claim 10, wherein the return passage is selectively fluidly connectable to a region of the interior cavity of the heat exchanger having a lower pressure than the pressure within the return passage.

15. The heating apparatus of claim 14 further comprising a valve operable to selectively fluidly connect the return passage to the interior cavity of the heat exchanger.

16. A heating apparatus connectable to fluid supply source that supplies a fluid to be heated, the heating apparatus comprising:

a hydrodynamic heater including a hydrodynamic chamber disposed within an interior cavity of the hydrodynamic heater, the hydrodynamic chamber operable for selectively heating the fluid present within the hydrodynamic chamber when the heating apparatus is connected to the fluid supply source, the hydrodynamic heater having an inlet port and a discharge port;

a heat exchanger having an inlet port and a discharge port;

a discharge passage directly fluidly connecting the discharge port of the hydrodynamic heater to the inlet port of the heat exchanger;

a return passage directly fluidly connecting the discharge port of the heat exchanger to the inlet port of the hydrodynamic hydrodynamic heater; a wall at least partially defining the interior cavity of the hydrodynamic heater and an interior cavity of the heat exchanger; and wherein substantially the entire discharge passage and the return passage are constructed from a substantially inelastic material.

17. The heating apparatus of claim 16 further comprising a heat exchanger core disposed within the interior cavity of the heat exchanger.

18. The heating apparatus of claim 17, wherein the return passage is selectively fluidly connectable to a region of the interior cavity of the heat exchanger having a lower pressure than the pressure within the return passage.

19. The heating apparatus of claim 18 further comprising a valve operable to selectively fluidly connect the return passage to the interior cavity of the heat exchanger.

* * * * *